United States Patent [19]

Amr et al.

[11] Patent Number: 5,066,194

[45] Date of Patent: Nov. 19, 1991

[54] FAN ORIFICE STRUCTURE AND COVER FOR OUTSIDE ENCLOSURE OF AN AIR CONDITIONING SYSTEM

[75] Inventors: Yehia M. Amr, Manlius, N.Y.; W. Joseph Fallows, III, Windsor, Mass.; Mark R. Hogan, Manlius, N.Y.

[73] Assignee: Carrier Corporation, Syracuse, N.Y.

[21] Appl. No.: 653,378

[22] Filed: Feb. 11, 1991

[51] Int. Cl.[5] ..... F01D 9/04

[52] U.S. Cl. ..... 415/223; 415/208.2; 415/211.2; 165/125

[58] Field of Search ..... 165/125; 123/41.49; 415/182.1, 208.1-208.3, 211.2, 223; 416/169 A

[56] References Cited

U.S. PATENT DOCUMENTS

| | | | |
|---|---|---|---|
| 3,799,128 | 3/1974 | Small | 123/41.49 |
| 3,903,960 | 9/1975 | Beck et al. | 165/51 |
| 4,202,409 | 5/1980 | Cann et al. | 165/122 |
| 4,213,426 | 7/1980 | Longhouse | 123/41.49 |
| 4,357,914 | 11/1982 | Hauser | 123/41.49 |
| 4,454,641 | 6/1984 | Haas et al. | 165/125 X |
| 4,548,548 | 10/1985 | Gray, III | 416/189 |
| 4,566,852 | 1/1986 | Hauser | 415/182 |

*Primary Examiner*—Allen J. Flanigan

[57] ABSTRACT

A fan orifice structure and cover intended for use in conjunction with the outside enclosure, usually containing the outside heat exchanger and compressor, of an air conditioning system. The orifice features relatively complex contours that enhance fan efficiency and reduce radiated noise. The cover in which the orifice structure is incorporated can include a plurality of fan motor support brackets and a motor mount. The orificed cover is intended for fabrication from plastic materials by a molding process to minimize cost and weight, maximize strength and durability and to present an aesthetically pleasing appearance. The entire assembly can be molded into a single piece unit.

12 Claims, 4 Drawing Sheets

FAN ORIFICE STRUCTURE AND COVER FOR OUTSIDE ENCLOSURE OF AN AIR CONDITIONING SYSTEM

BACKGROUND OF THE INVENTION

This invention relates generally to air conditioning systems. More particularly, the invention relates to an orifice structure for the fan that moves air through the enclosure that houses the outside heat exchanger of what is known as a "split" air conditioning or heat pump system and to a cover for the enclosure that incorporates the orifice structure.

In a split air conditioning system, one of the air-to-refrigerant heat exchangers of the system is located outside the space (usually outside the building) to be conditioned. The outside heat exchanger is usually contained in an enclosure that also contains the compressor and other system components. A fan in the enclosure forces a flow of air through the heat exchanger to promote heat transfer between the air and the refrigerant.

The outside heat exchanger of the typical split system is of the plate fin and tube type with the tubing arranged in some fashion around the periphery of the enclosure. The walls of the enclosure are louvered and the fan is mounted at the top of the enclosure so that the flow of air is into the enclosure through the louvered walls, through the heat exchanger and fan and out of the enclosure through an opening in the top. The fan is usually surrounded by a fan orifice. The function of the orifice is to guide the flow of air through the fan in a manner that will improve air flow efficiency and reduce radiated noise.

For a given system design and capacity, there is a certain minimum air flow required through the outside heat exchanger. The design of the outside enclosure must enable the attainment of that airflow. At the same time, other seemingly mutually exclusive considerations entering into the design of the enclosure include optimizing the air flow efficiency in order to minimize energy consumption and radiated noise, making the enclosure able to withstand adverse weather and other conditions, minimizing overall size and manufacturing cost and providing an aesthetically pleasing external appearance.

In order to minimize overall height of the enclosure, many prior art outside enclosure designs feature a fan and fan orifice recessed into the center of the heat exchanger tubing array. This is effective in reducing enclosure height but is less than desirable from an air flow perspective. Such a design can result in reduced air flow over the uppermost regions of the heat exchanger with a corresponding reduction in heat transfer effectiveness in those regions, inefficient air flow eddies and separations upstream and downstream of the fan and its orifice, energy losses and increased radiated noise.

Advances in materials technology and fabrication techniques have led to the use of plastics in a wide variety of new applications. Modern plastics can be strong, durable, damage resistant, lightweight and competitive in manufacturing cost with other materials. Moreover, the ability to easily mold plastic material has enabled the production of components in complex shapes that have previously been difficult and uneconomical to manufacture.

SUMMARY OF THE INVENTION

An object of the present invention is to increase the efficiency of a split air conditioning system by achieving the same or increased air flow through the system outside heat exchanger without an increase in fan energy consumption.

Another object of the present invention is to reduce the radiated noise attributable to air flow in the outside unit of the system.

Another object of the present invention is to attain uniform air flow through all regions of the outside heat exchanger, thus allowing a reduction in the size of the heat exchanger. Still another object of the present invention is to achieve the same or better heat transfer capability in an outside heat exchanger that is smaller than prior art heat exchangers of the same capacity by increasing the air flow rate through it.

Yet another object of the present invention is to provide a fan orifice in an outside enclosure cover that is lightweight, strong, durable, inexpensive to manufacture and aesthetically pleasing in appearance.

These and other objects of the present invention are attained in a novel fan orifice structure that enhances air flow through the heat exchanger enclosure and its fan. The orifice structure is designed to be fitted around a fan. Both the fan and the orifice structure are designed to be mounted above the uppermost region of the heat exchanger. The positioning and configuration of the orifice structure in this way results in a better distribution of air flow through the entire heat exchanger and therefore increased overall heat transfer capability for the heat exchanger over prior art arrangements in which fans are recessed into the heat exchanger cavity. Because of the increased heat transfer capacity of the heat exchanger in this configuration, the overall size of the heat exchanger can be reduced. An enclosure incorporating the nonrecessed fan and orifice structure and cover of the present invention together with a heat exchanger of the reduced size can be no taller than a prior art enclosure using a recessed fan and requires less material to fabricate.

The orifice structure of one embodiment of the present invention is generally circular in a plane normal to the axis of rotation of the fan with which it is associated. The orifice is generally ellipsoidal from its leading (with respect to air flow through the fan and orifice) edge through its inlet and throat sections and then flares out through its discharge section to its trailing edge. The trailing edge need not however be circular in a plane normal to the fan axis of rotation but may be some other configuration, e.g. generally square or rectangular.

The clearances between the orifice structure and the fan that will be used with it are kept to a minimum consistent with those necessary due to manufacturing, installation and other tolerances in order to minimize tip vortices, flow separations and the associated radiated noise produced and efficiency losses suffered.

The orifice structure can be incorporated into a one piece molded cover that is both utilitarian and decorative. The cover can include support and a mount for the motor that drives the fan, can provide structural strength to the enclosure, protection to system components inside the enclosure and enhance the external appearance of the enclosure. The relatively complex contours of the orifice can be readily produced in a structure of plastic by a molding process.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENTS

Figure 1:
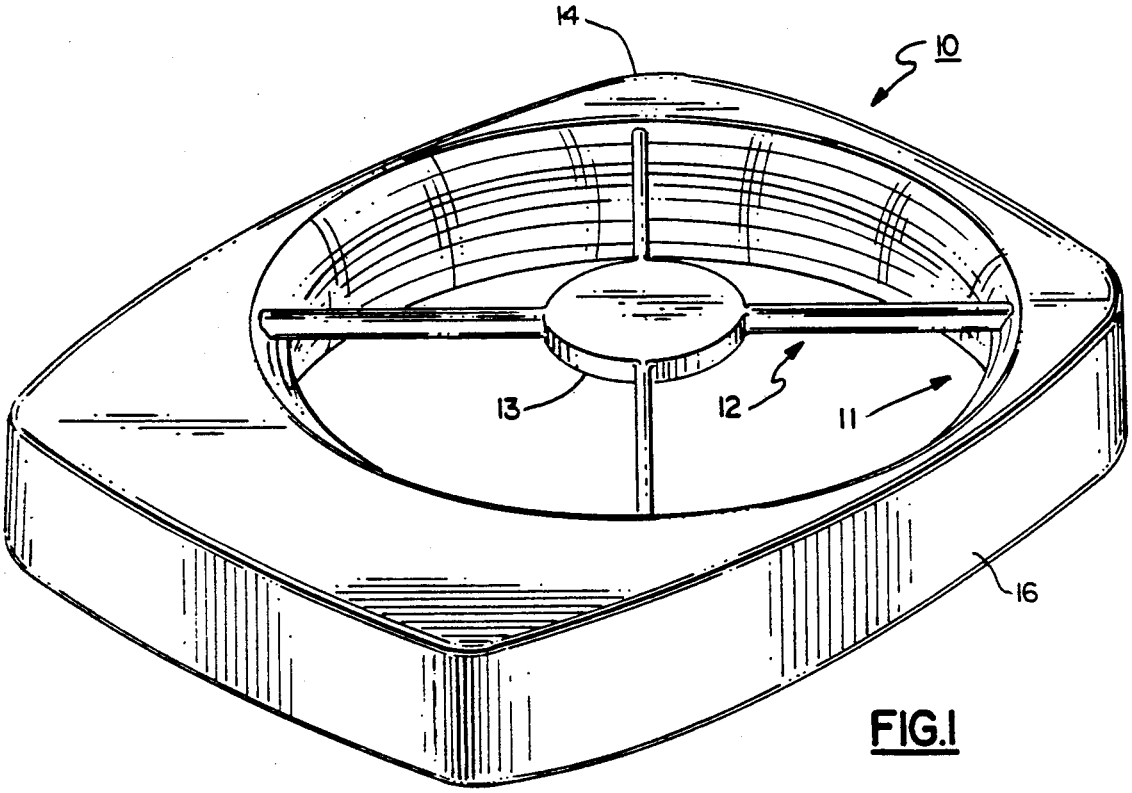
FIG. 1 is a perspective view of the orifice structure and cover of the present invention.

FIG. 1 provides an overall view of one embodiment of the orifice structure and cover of the present invention. In FIG. 1 are shown enclosure cover 10 for the outside heat exchanger enclosure of a split air conditioning or heat pump system. Cover 10 has an upper side 14, a lower side (not shown in this view) and an outer perimeter 16. Extending through cover 10 from the lower side to upper side 14 is an orifice for a fan defined by orifice wall 11. Extending radially inwardly from orifice wall 11 are a plurality of fan motor support brackets 12 that, through motor mount 13, provide support for the fan and its electric motor (neither shown in this view) that are associated with the fan orifice and which causes a flow of air through the outside heat exchanger enclosure. A fan grille or finger guard (not shown) will usually be installed over the discharge end of the orifice. Fan motor support brackets 12 also provide means for supporting the grille.

Figure 2:
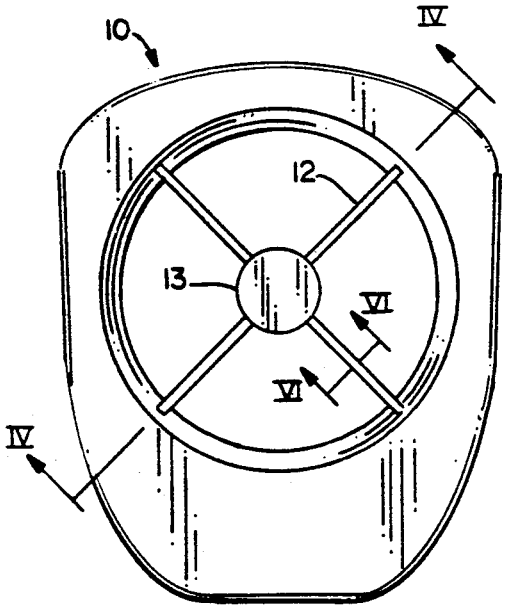
FIG. 2 is a plan view of the orifice structure and cover of the present invention.
Figure 6:
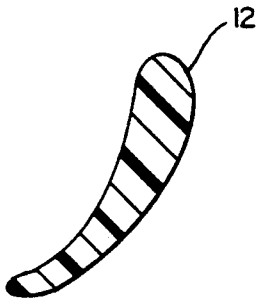
FIG. 6 is a sectioned elevation view of the fan support bracket of the cover of the present invention taken through line VI—VI of FIG. 2.
Figure 4:
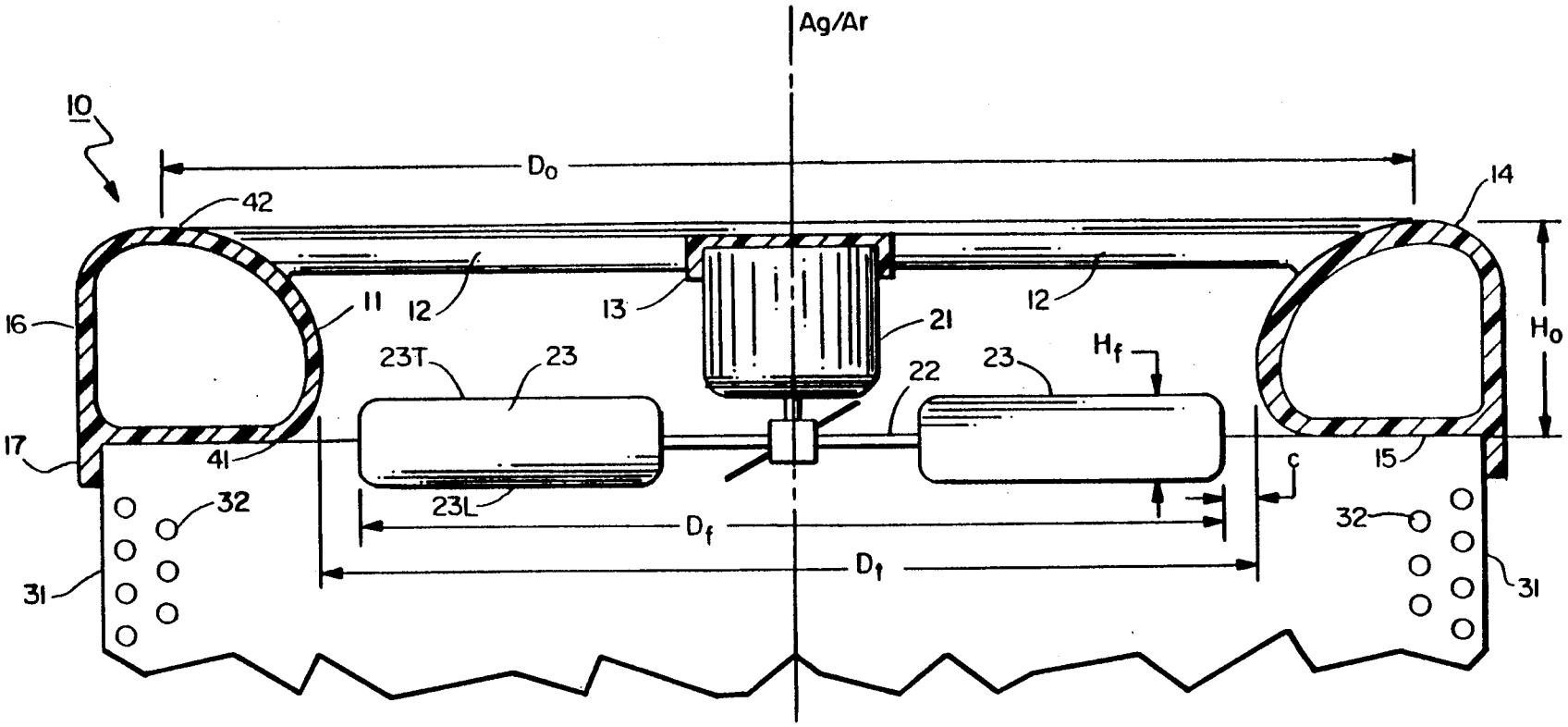
FIG. 4 is a sectioned elevation view of the cover and one embodiment of the orifice structure of the present invention taken through line IV—IV of FIG. 2 and as it would be installed on an outside enclosure of an air conditioning system having a bladed axial flow fan and motor.

FIG. 2 is a plan view of cover 10 and illustrates sections through cover 10 and fan motor support bracket 12 that are depicted in FIGS. 4 and 6 respectively.

Figure 3:
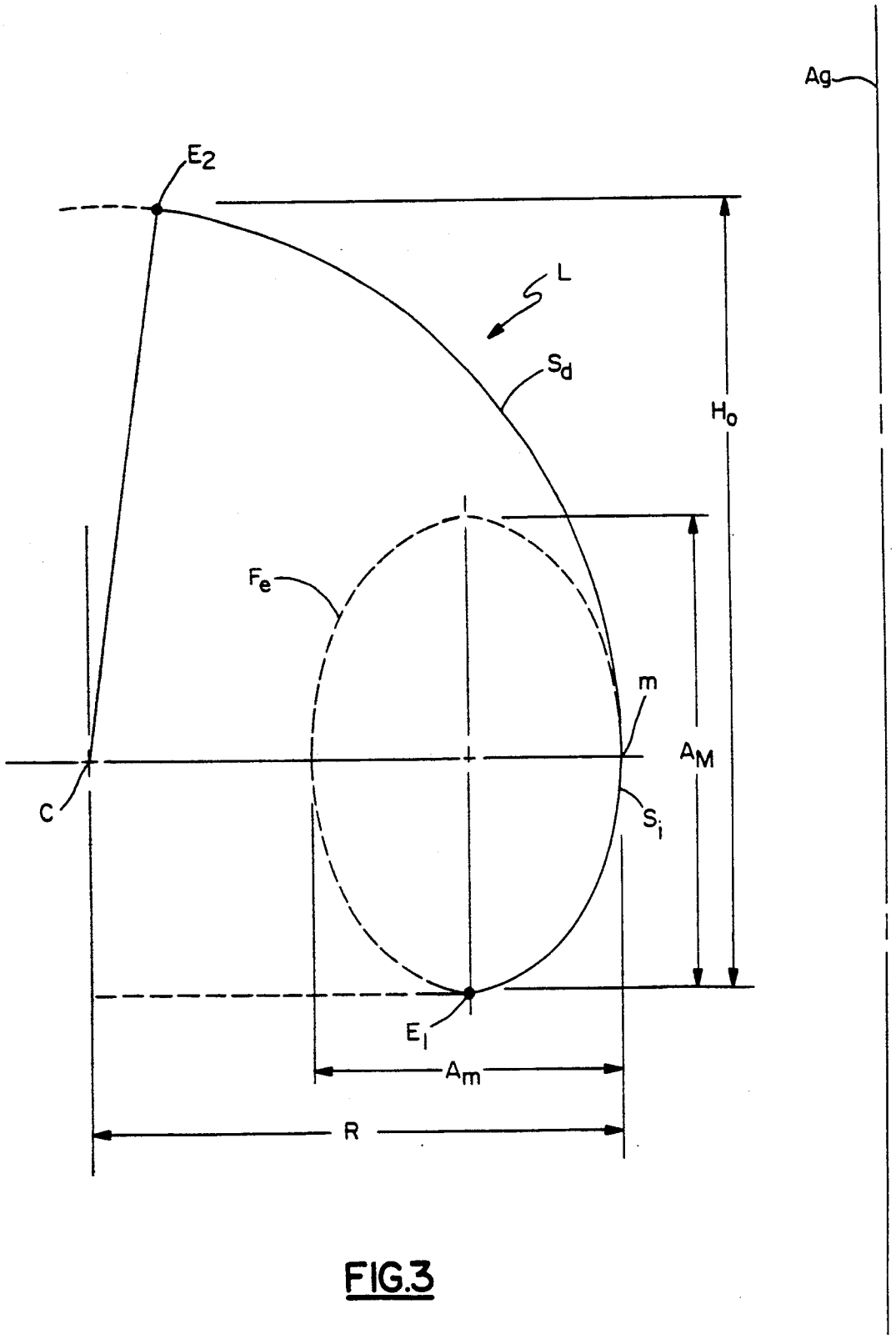
FIG. 3 is a view of the planar and curvilinear line that will, when rotated about a coplanar axis of generation, produce the surface of the orifice structure of the present invention.

One means of defining the curved surface of orifice wall 11 of the embodiment of the present invention depicted in FIG. 2 is by describing it as the surface that would be generated by rotating a planar and curvilinear line about a coplanar axis of generation. That line L is depicted in FIG. 3. The motor and fan that will operate in conjunction with the orifice will, of course, be installed so that their common axis of rotation will be coincident with the axis of generation of the surface of orifice wall 11.

As will be discussed below, certain features of line L are dependent on characteristics of the fan with which the orifice is associated, but in general, the salient features of line L are its two ends, $E_1$ and $E_2$, segments $S_i$ and $S_d$, and point m, that lies on line L where segments $S_i$ and $S_d$ meet.

End $E_1$, when rotated about axis of generation $A_g$, will generate the leading edge of orifice wall 11.

End $E_2$, when rotated, will generate the trailing edge of orifice wall 11. End $E_2$ is located with respect to end $E_1$ axially (parallel to axis of generation $A_g$) a distance $H_o$ downstream from end $E_1$ (the value of $H_o$ will be discussed below) and radially from axis of generation $A_g$ such that, when rotated, it will generate a trailing edge. For best air flow characteristics and performance end $E_2$ should be radially displaced from axis of generation $A_g$ so that the trailing edge generated will have the largest possible diameter that the restraints of the physical dimensions of cover 10 and non air flow related design considerations will allow.

Segment $S_i$ is a portion of ellipsoid $F_e$. Ellipsoid $F_e$ has major axis $A_M$ and minor axis $A_m$. The relationship between $A_m$ and $A_M$ will be discussed below. $A_M$ is parallel to axis of generation $A_g$. When $S_i$ is rotated, it will generate the inlet portion of orifice wall 11.

Point m is the intersection of line L with minor axis $A_m$ and the point on line L where segments $S_i$ and $S_d$ meet. When it is rotated, point m will generate the throat, or region of minimum diameter, of orifice wall 11.

The configuration of the segment of line L that will, when rotated, generate the discharge portion of orifice wall 11 is not critical to the performance of the orifice. Segment $S_d$ depicted in FIG. 3 will, when rotated, produce a discharge portion that produces satisfactory results and is pleasing aesthetically. Segment $S_d$ is the arc of a circle having a radius R, a center C lying on the extension of minor axis $A_m$ away from axis generation $A_g$ and connecting point m and end $E_2$. Another satisfactory configuration (not shown) for the discharge portion of orifice wall 11 is the surface produced by rotating a straight line from end $E_2$ tangent to ellipse $F_e$ on the side of $F_e$ toward axis of rotation $A_g$.

FIG. 4, a sectioned elevation view taken along line IV—IV in FIG. 2, shows one embodiment of the cover and orifice structure of the present invention. In FIG. 4, cover 10 is installed on air conditioning system outside enclosure 31 Heat exchanger tubing 32, carrying fluid refrigerant, is arranged in a coil like configuration around the periphery of enclosure 31. Supported by fan motor brackets 12 is fan motor mount 13. Mounted in fan motor mount 13 is fan motor 21. Mounted on the shaft of fan motor 21 is fan 22 having a plurality of blades 2 . Fan motor 21 and fan 22 are mounted with respect to orifice wall 11 so that axis of rotation $A_r$ of fan 22 is coincident with axis of generation $A_g$ of orifice wall 11. Cover 10 has upper side 14, lower side 15, outer perimeter 16 and skirt 17 extending below lower side 15. Leading edge 41 is where orifice wall 11 joins lower side 15. Trailing edge 42 is similarly where orifice wall 11 joins upper side 14.

The shape and configuration of outer perimeter 16 and the relative size and positioning of orifice wall 11 in cover 10 with respect to outer perimeter 16 are determined by a number of design considerations, including the overall size of enclosure 31, the configuration and capacity of heat exchanger coil 32, strength and appearance. Since the present invention envisions that cover 10 will be molded of plastic and have a hollow cavity between outer perimeter 16 and orifice wall 11, the cover can easily be configured to contain space for the installation of electrical controls or other components associated with the equipment located in enclosure 31 without interfering with the configuration required for proper air flow nor with good external appearance. Skirt 17 provides a means for securing cover 10 to enclosure 31 and also provides a measure of structural support to the vertical walls of the enclosure.

Certain dimensions of the orifice structure of the embodiment of the present invention are related to dimensions of the fan with which it will operate. Those fan dimensions are:

Swept diameter $D_f$—the diameter of the circle described when the point on fan blade 23 that is farthest from axis of rotation $A_r$ rotates about that axis; and Blade axial depth $H_f$—the normal distance between a first plane normal to axis of rotation $A_r$ passing through a point on blade leading edge 23L that is four tenths (0.4) of swept diameter $D_f$ from axis of rotation $A_r$ and a second plane normal to axis of rotation $A_r$ passing through a point on blade trailing edge 23T that is four tenths (0.4) of swept diameter $D_f$ from axis of rotation $A_r$. Minimum orifice height $H_o$ is the minimum height of orifice wall 11. Since leading edge 41 and trailing edge 42 join with lower side 15 and upper side 14 respectively, $H_o$ will generally also be the overall height of cover 10, but may be less, if a grille or guard is added to the cover at the discharge end of the orifice. A minimum orifice height is desirable so that there is sufficient distance between the trailing edge of the fan and a grille or guard to allow local disturbances in the air flow exiting the fan to attenuate before the air passes through the grille or guard and thus minimize air flow induced noise at the grille or guard.

Throat diameter $D_t$ is the minimum diameter of orifice wall 11. Clearance c is the tip clearance or $D_t - D_f/2$. Discharge diameter $D_o$ is the diameter of orifice wall 11 at its trailing edge 42.

In the embodiment of the orifice structure of the present invention depicted in FIG. 4 with an orifice wall having a surface as would be generated by rotation of a line as depicted in FIG. 3:

the minor axis of the ellipsoid should be between forty to seventy five thousandths of the swept diameter of the fan or $$A_m = (0.04 \text{ to } 0.075)D_f;$$

the ratio of the major axis to the minor axis of the ellipsoid should be between one and two and one half or $$A_M = (1.0 \text{ to } 2.5)A_m;$$

for a fan having a blade axial depth of fifteen to twenty five hundredths of its swept diameter, the minimum orifice height should be half the blade axial depth plus between six to twenty hundredths of the swept diameter of the fan or, $$\text{for } H_f = (0.15 \text{ to } 0.25)D_f;$$

$$H_o = H_f/2 + (0.06 \text{ to } 0.20)D_f;$$

the tip clearance should be between five and twenty thousandths of the swept diameter of the fan or $$c = (0.005 \text{ to } 0.020)D_f \text{ or}$$

$$D_t = (1.01 \text{ to } 1.04)D_f; \text{ and}$$

the discharge diameter, $D_o$, should be as great as other design considerations will allow.

Figure 5:
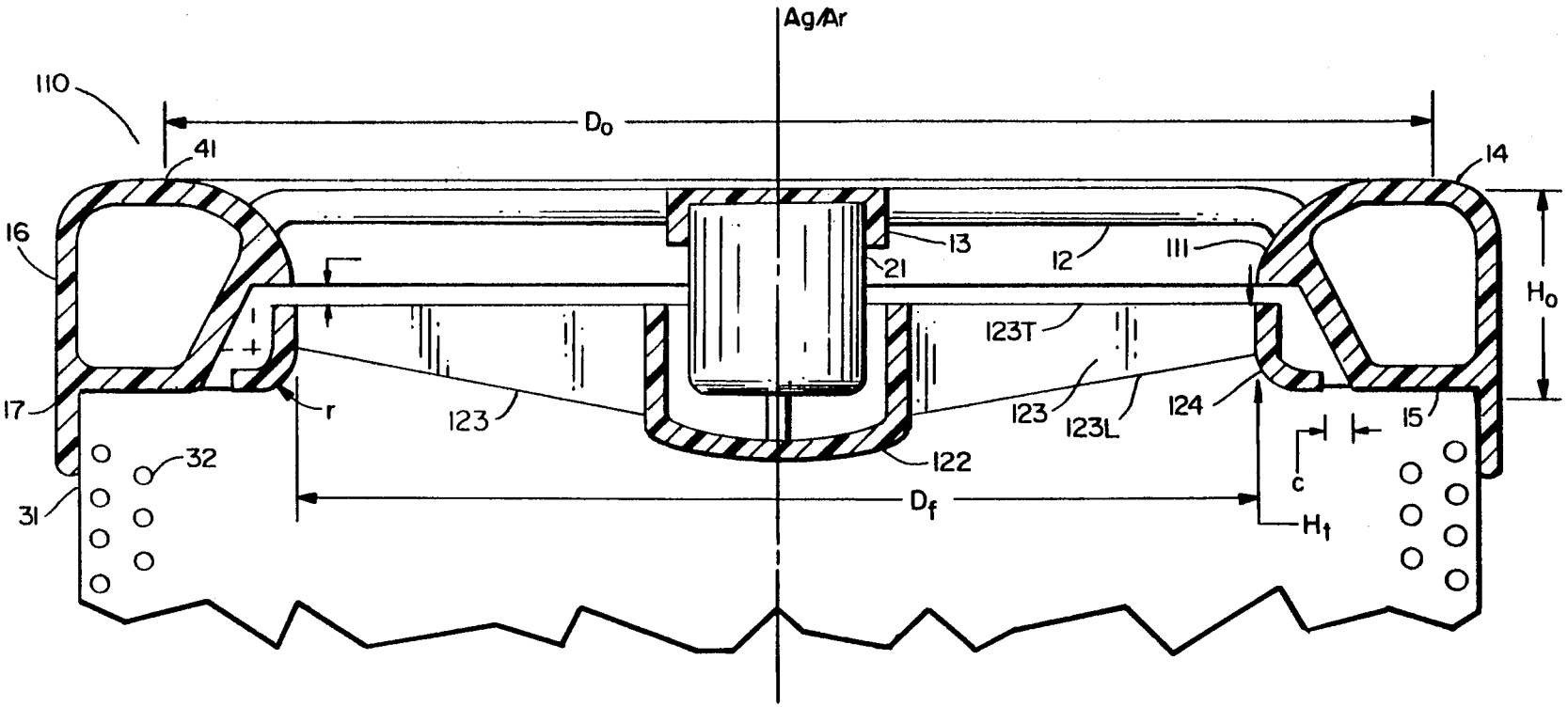
FIG. 5 is a sectioned elevation view of the cover and another embodiment of the orifice structure of the present invention taken through line IV—IV of FIG. 2 and as it would be installed on an outside enclosure having a bladed axial flow fan and motor.

FIG. 5, a sectioned elevation view taken through line IV—IV in FIG. 2, shows another embodiment of the cover and orifice structure of the present invention. The embodiment depicted in FIG. 5 is similar to that shown in FIG. 4 except that the orifice structure includes a shroud that is affixed to the tips of the fan blades and thus rotates with the fan. Many of the features of the two embodiments are the same or similar and therefore bear the same reference numerals in the two figures. Only the significant differences between the embodiment shown in FIG. 5 and that shown in FIG. 4 and described above will be pointed out.

In FIG. 5 is shown cover 110 having orifice wall 111. Mounted in motor mount 13 is fan motor 21, to which is mounted fan 122, having blades 123. Fan shroud 124 is affixed to the tips of blades 123 and rotates with fan 122. Ideally, the inner surface of shroud 124, e.g. the surface facing axis of rotation $A_r$ should have the same curvilinear surface as the inlet portion of orifice wall 11 (FIG. 4). Using appropriate materials and manufacturing techniques, a shroud with such a surface could be produced. However, as ones skilled in the art will appreciate, such a configuration would be difficult to fabricate out of plastic using a molding process. The configuration depicted in FIG. 5 therefore is a compromise between design and manufacturing, yielding comparable air flow performance to the surface of orifice wall 11 (FIG. 4) but capable of being readily manufactured using a process such as injection molding. This is achieved by making the inner surface of the inlet portion of orifice wall 111 like the surface that would be generated by the rotation of a straight line between the point where leading edge 123T of blade 123 joins shroud 124 and the point where trailing edge 123T joins the shroud, i.e. a cylinder whose axis is axis of rotation $A_r$. The remainder of the inlet portion of orifice wall 111 is like the surface that would be generated by rotating a segment of an ellipsoid having its major axis parallel to axis of generation $A_g$ about that axis. The ellipsoid segment depicted in FIG. 5 is one in which the major and minor axes are equal, i.e. a circle having radius r, but may be a segment of an ellipsoid having the same relationship between its minor axis and the swept diameter of the associated fan and between its minor and major axes as the embodiment depicted in FIG. 4 and discussed above.

As in the embodiment depicted in FIG. 4, certain important dimensions of the orifice structure of this embodiment of the present invention are related to dimensions of the fan with which it will operate. Blade tip axial depth $H_t$ is the axial distance between the point where leading edge 123L of blade 123 joins shroud 124 and the point where trailing edge 124T joins shroud 124. Swept diameter $D_t$ of fan 123 is twice the radial distance from axis of rotation $A_r$ to the point where leading edge 123L of blade 123 joins shroud 124 (or the point where trailing edge 124T joins shroud 124, as the two distances are equal). In this embodiment, swept diameter $D_f$ is equal to throat diameter $D_t$.

In this embodiment of the orifice structure of the present invention (as depicted in FIG. 5):

the radius of the curved segment of the inlet of the orifice structure that is embodied in the shroud should have a radius of between two and five hundredths of the fan swept diameter or $$r = (0.02 \text{ to } 0.05)D_f;$$

the minimum orifice height should be half the blade axial depth plus between six to twenty hundredths of the swept diameter of the fan or, $$H_o = H_f/2 + (0.06 \text{ to } 0.20)D_f;$$

the tip clearances should be between five and twenty thousandths of the swept diameter of the fan or $$c = (0.005 \text{ to } 0.020)D_f; \text{ and}$$

the discharge diameter, $D_o$, should be as great as other design considerations will allow.

FIG. 6, a sectioned elevation view taken along line VI—VI in FIG. 2, depicts the structure of fan motor support 12 in cross section. In either of the embodiments of the present invention depicted in FIGS. 4 and 5 and described above, the plurality of fan motor supports 12 can be configured and function as exit stator vanes. If so configured, they can have a cross section such as is depicted in FIG. 6 that will recover energy imparted by the fan in the form of swirl to the air flow, energy that would otherwise be lost. This is accomplished by configuring the supports so as to redirect the air departing the rotating blades of the fan so that the tangential component of the flow is reduced.

Describing the entire orifice wall in terms of a surface generated by rotating a line about an axis as has been done in the above discussion is primarily for simplicity and ease of explanation. The leading edge, inlet portion and throat of the orifice wall must necessarily be circular in order to achieve a close fit around the fan with which the orifice is used, but the discharge portion and trailing edge of the wall need not be circular. Equally satisfactory is a configuration in which the trailing edge is not circular but some other shape, e.g. substantially square or rectangular, as might be more appropriate when it is desired to conform to the top of an outside enclosure that is not circular. In all cases, the area enclosed by the trailing edge should be as large as possible consistent with other design considerations. The discharge portion of the orifice wall should smoothly transition from the throat to the trailing edge with no cross sectional area, taken in a plane normal to the axis of rotation of the fan, in the discharge section of the orifice being less than the cross sectional area of the orifice throat. It is also not necessary that the plane containing the orifice leading edge be parallel to the plane containing the orifice trailing edge, as deviation from such parallelism will not adversely affect orifice performance.

The cover and orifice surface of the present invention, in any of the embodiments described and discussed above, can be produced from a number of suitable materials by a number of manufacturing processes. The embodiments are particularly well suited, however, to manufacturing from a plastic such as polyethylene using molding processes. It is possible to mold a cover embodying the orifice, fan motor supports and motor mount that is a single piece by a blow molding process. A fan having affixed the shroud embodying the surface of the orifice wall can be readily made by an injection molding process.

While the above describes particular embodiments of the present invention, other embodiments that are within the scope of the invention may occur to one skilled in the art. The above description should be construed as illustrative and the scope of the invention limited only by the scope of the below claims.

What is claimed is:

1. An orifice structure, for use with an axial flow fan having an axis of rotation, comprising a wall having
- a circular wall leading edge,
- a circular throat,
- an inlet portion extending from said wall leading edge to said throat,
- a wall trailing edge downstream with respect to said axial flow from said throat and
- a discharge portion extending from said throat to said wall trailing edge,
  - said inlet portion comprising a surface produced by rotating a planar line about a coplanar axis of generation coincident with said axis of rotation, said line being a generally quarter segment of an ellipsoid having a major axis substantially parallel to said axis of generation.

2. A fan and fan orifice assembly comprising:

a fan of the axial flow type having
- an axis of rotation,
- a plurality of blades extending radially from an axis of rotation, each of said blades having a blade leading edge, a blade trailing edge and a tip,
- a swept diameter, said swept diameter being the diameter of the circle described when that point on a blade tip that is farthest from said axis of rotation rotates about said axis of rotation, and
- a blade axial depth, said blade axial depth being the normal distance between a first plane normal to said axis of rotation passing through a point on said blade leading edge that is four tenths (0.4) of said swept diameter from said axis of rotation and a second plane normal to said axis of rotation passing through a point on said blade trailing edge that is four tenths (0.4) of said swept diameter from said axis of rotation; and an orifice structure comprising a wall having
- a circular wall leading edge,
- a circular throat,
- an inlet portion extending from said wall leading edge to said throat,
- a wall trailing edge downstream with respect to said axial flow from said throat,
- a discharge portion extending from said throat to said wall trailing edge and
- an axial distance from said wall leading edge to said wall trailing edge, said inlet portion comprising a surface produced by rotating a planar line about a coplanar axis of generation coincident with said axis of rotation, said line being a generally quarter segment of an ellipsoid having
- a minor axis that is between forty and seventy five thousandths (0.04 and 0.075) of said swept diameter and
- a major axis that is substantially parallel to said axis of generation and two and one half ($1 < A_m \leq 2.5$) times said minor axis, said axial distance being one half ($\frac{1}{2}$) said blade axial depth plus six to twenty hundredths (0.06 to 0.20) of said swept diameter.

3. The fan and fan orifice assembly of claim 2 in which the clearance between said blade tips and said throat is between five and twenty thousandths (0.005 to 0.020) of said swept diameter.

4. The fan and fan orifice assembly of claim 2 in which said fan is shrouded with said shroud being affixed to said blade tips and rotating with said fan tips and said inlet and throat portions of said wall being embodied in said shroud.

5. A cover for an enclosure housing the outside heat exchanger of an air conditioning system, said enclosure having an outer perimeter, comprising:

a main body having an upper side, a lower side and an outer perimeter generally conforming to said enclosure outer perimeter; and an orifice structure, for an axial flow fan having an axis of rotation, extending through said main body from said lower side to said upper side, said orifice structure comprising a wall having a circular wall leading edge, a circular throat, an inlet portion extending from said wall leading edge to said throat, a wall trailing edge downstream with respect to said axial flow from said throat and a discharge portion extending from said throat to said wall trailing edge, said inlet portion comprising a surface produced by rotating a planar line about a coplanar axis of generation coincident with said axis of rotation, said line being a generally quarter segment of an ellipsoid having a major axis substantially parallel to said axis of generation.

6. The cover of claim 5 further comprising means for securing said cover to said enclosure.

7. The cover of claim 6 in which said securing means is a skirt extending downward from said lower side at said cover outer perimeter.

8. The cover of claim 8 in which said fan is directly driven by an electric motor and further comprising a plurality of fan motor support brackets extending inwardly from said wall of said orifice toward said axis of fan rotation; and a fan motor mount supported by said fan motor support brackets.

9. The cover of claim 8 in which said fan motor support brackets also function as stator vanes.

10. The cover of claim 8 in which said main body, said orifice structure, said fan motor support bracket and said fan motor mount are fabricated by molding into a single piece structure.

11. The cover of claim 5 further comprising means for attaching a fan guard or grille.

12. A cover and fan assembly for an enclosure housing the outside heat exchanger of an air conditioning system, said enclosure having an outer perimeter, comprising:

a main body having an upper side, a lower side and an outer perimeter generally conforming to said enclosure outer perimeter;

an orifice structure having a wall extending through said main body from said lower side to said upper side;

a plurality of fan motor support brackets extending inwardly from said orifice structure wall;

a fan motor mount supported by said fan motor support brackets;

a fan directly driven by an electric motor mounted in said fan motor mount, said fan being of the axial flow type having a plurality of blades extending radially from an axis of rotation, each of said blades having a blade leading edge, a blade trailing edge and a tip, a swept diameter, said swept diameter being the diameter of the circle described when that point on a blade tip that is farthest from said axis of rotation rotates about said axis of rotation, and a blade axial depth, said blade axial depth being the normal distance between a first plane normal to the rotational axis of said fan passing through a point on said blade leading edge that is four tenths (0.4) of said swept diameter from said axis of rotation and a second plane normal to said axis of rotation passing through a point on said blade trailing edge that is four tenths (0.4) of said swept diameter;

with said orifice wall having a circular wall leading edge, a circular throat, an inlet portion extending from said wall leading edge to said throat, a wall trailing edge downstream with respect to said axial flow from said throat and a discharge portion extending from said throat to said wall trailing edge, said inlet portion comprising a surface produced by rotating a planar line about a coplanar axis of generation coincident with the axis of rotation of said fan, said line being a generally quarter segment of an ellipsoid having a major axis and a minor axis, said major axis being substantially parallel to said axis of generation and substantially greater than one to approximately two and one half ($1 < A_m \leqq 2.5$) times said minor axis and said minor axis of said ellipsoid being between forty and seventy five thousandths (0.04 and 0.075) of said swept diameter, and the axial distance from said wall leading edge to said wall trailing edge is equal to one half ($\frac{1}{2}$) said blade axial depth plus six to twenty hundredths (0.06 to 0.20) of said swept diameter.

* * * * *

UNITED STATES PATENT AND TRADEMARK OFFICE

CERTIFICATE OF CORRECTION

PATENT NO. : 5,066,194

DATED : 19 November 1991

INVENTOR(S) : Amr, et al.

It is certified that error appears in the above-identified patent and that said Letters Patent are hereby corrected as shown below:

In the Claims:

Claim 2, lines 40-41 (column 8, lines 60-61) and claim 12, line 52 (column 10, line 48):

"one half ($1 < A_m \leq 2.5$) times" should read

--one half ($1 < A_M \leq 2.5$) times--.

Signed and Sealed this

Fourteenth Day of September, 1993

Bruce Lehman

*Attest:*

BRUCE LEHMAN

*Attesting Officer*

*Commissioner of Patents and Trademarks*